United States Patent [19]

Byrley

[11] Patent Number: 4,735,290

[45] Date of Patent: Apr. 5, 1988

[54] SYSTEM AND METHOD FOR DISPLAYING, VENDING AND CONTROLLING INVENTORY OF VALUABLE ARTICLES SUCH AS PRE-RECORDED VIDEOTAPE CASSETTES

[75] Inventor: Frank Byrley, Dallas, Tex.

[73] Assignee: The Southland Corporation, Dallas, Tex.

[21] Appl. No.: 19,426

[22] Filed: Feb. 26, 1987

[51] Int. Cl.[4] ..... E04H 3/04; G09F 1/00

[52] U.S. Cl. ..... 186/52; 40/19.5; 40/124.2; 186/35; 283/1 R

[58] Field of Search ..... 186/35, 36, 52, 55, 186/56; 40/10 D, 19.5, 124, 124.1, 124.2; 283/1 R, 56

[56] References Cited

U.S. PATENT DOCUMENTS

| | | | |
|---|---|---|---|
| 2,105,594 | 1/1938 | Henrich | 40/124.2 X |
| 2,353,002 | 7/1944 | Armbruster | 186/56 X |
| 3,532,184 | 10/1970 | Blake | 186/56 |
| 3,920,100 | 11/1975 | Dunphy | 186/56 X |
| 4,003,470 | 1/1977 | Lagorio | 40/124.2 X |
| 4,056,190 | 11/1977 | Dix | 40/19.5 X |
| 4,130,197 | 12/1978 | Fox | 40/124.2 X |
| 4,179,831 | 12/1979 | Cook | 40/19.5 |
| 4,245,414 | 1/1981 | Shypula | 40/124 |
| 4,654,988 | 4/1987 | Ericksen | 40/19.5 X |

FOREIGN PATENT DOCUMENTS

| | | | |
|---|---|---|---|
| 2034031 | 1/1972 | Fed. Rep. of Germany | 40/124.2 |
| 1270131 | 7/1961 | France | 40/124.2 |

*Primary Examiner*—Joseph J. Rolla
*Assistant Examiner*—Kevin P. Shaver
*Attorney, Agent, or Firm*—Cushman, Darby & Cushman

[57] ABSTRACT

In an area accessible to browsing customers, at least one multiple-compartment display rack is provided. Each cell in the display rack removably receives an open-ended transparent plastic envelope containing a display card preferably printed with photographics, artwork and verbal indicia unique to a particular valuable article or service which is potentially available. Filed in series with the display card so as to have an end which protrudes further from the envelope mouth than the display card are a number of cards (from one to a plurality) which are tokens of units of the particular article or service, plus an additional card. Each of the first mentioned cards contains on its protruding end a consumer instruction, such as "TAKE CARD TO REGISTER", and elsewhere on its body, the title of the particular article to service. The additional card bears as its flag a consoling legend, such as "SORRY I'M RENTED". At the check-out register, the card of the first type is exchanged for the actual boxed pre-recorded video cassette or other particular article or service, and each first-type card so exchanged may be temporarily placed as a token in the inaccessible-to-customers supply area for inventory control purposes, until the rented article is returned, a restocking inventory is taken, or the like. The display rack thus acts as a more compact analog of the inaccessible supply than would a display rack of empty boxes for the articles or the like.

14 Claims, 3 Drawing Sheets

SYSTEM AND METHOD FOR DISPLAYING, VENDING AND CONTROLLING INVENTORY OF VALUABLE ARTICLES SUCH AS PRE-RECORDED VIDEOTAPE CASSETTES

BACKGROUND OF THE INVENTION

It is a common practice in urban stores specializing in the sale of pre-recorded audio tapes, for the self-service display racks through which customers are invited to browse, to contain empty cassette boxes which boxes bear as an inner wrapper (if they are transparent), or as an outer label (if they are opaque), the, very album cover with which the publisher has supplied the pre-recorded audio cassette. Each album cover typically contains photographs and/or artwork and verbal graphics which are distinctive of the particular recording and not only act as informative material for the potential customers, but also permit potential customers to quickly pick out recordings which they have come to recognize by having previously seen the same album covers as reproduced in display advertising in newspapers and in other print and electronic media. Under the conventional system which usually pertains in such shops, the actual pre-recorded cassettes are stored out-of-sight, i.e. under the counter near the check-out register. The intending customer takes the empty but labeled box from the display rack and brings it to the register, where the store employee fills it with the respective cassette from the storage place, at the same time posting an inventory control entry, e.g. via the check-out register as the sale is made and/or by simultaneously removing to an inventoring site some token of the sold item from the storage place.

While such a system is likely to be very acceptable for a store which is primarily devoted to sales of pre-recorded audio cassetes or the like, it is deemed to be impractical for stores in which selling space is at a premium, particularly but not necessarily where the merchandise is bulky, the store wishes to stock multiple copies of many of the items, and the items are being rented, leased or lent, rather than being sold.

Although the invention which has been made for solving the drawbacks of available systems was particularly devised as a way of renting pre-recorded videocassettes from display racks accessible to customers in convenience stores, it should be apparent following absorption of the disclosure of the present invention, that it could be used in the vending of other articles (such as rental tools) and services (such as seating for events in a theater, arena or stadium).

SUMMARY OF THE INVENTION

In an area accessible to browsing customers, at least one multiple-compartment display rack is provided. Each cell in the display rack removably receives an open-ended transparent plastic envelope containing a display card preferably printed with photographics, artwork and verbal indicia unique to a particular valuable article or service which is potentially available. Filed in series with the display card so as to have an end which protrudes further from the envelope mouth than the display card are a number of cards (from one to a plurality) which are tokens of units of the particular article or service, plus an additional card. Each of the first mentioned cards contains on its protruding end a consumer instruction, such as "TAKE CARD TO REGISTER", and elsewhere on its body, the title of the particular article or service. The additional card bears as its flag a consoling legend, such as "SORRY I,M RENTED". At the check-out register, the card of the first type is exchanged for the actual boxed pre-recorded video cassette or other particular article or service, and each first-type card so exchanged may be temporarily placed as a token in the inaccessible-to-customers supply area for inventory control purposes, until the rented article is returned, a restocking inventory is taken, or the like. The display rack thus acts as a more compact analog of the inaccessible supply than would a display rack of empty boxes for the articles or the like.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
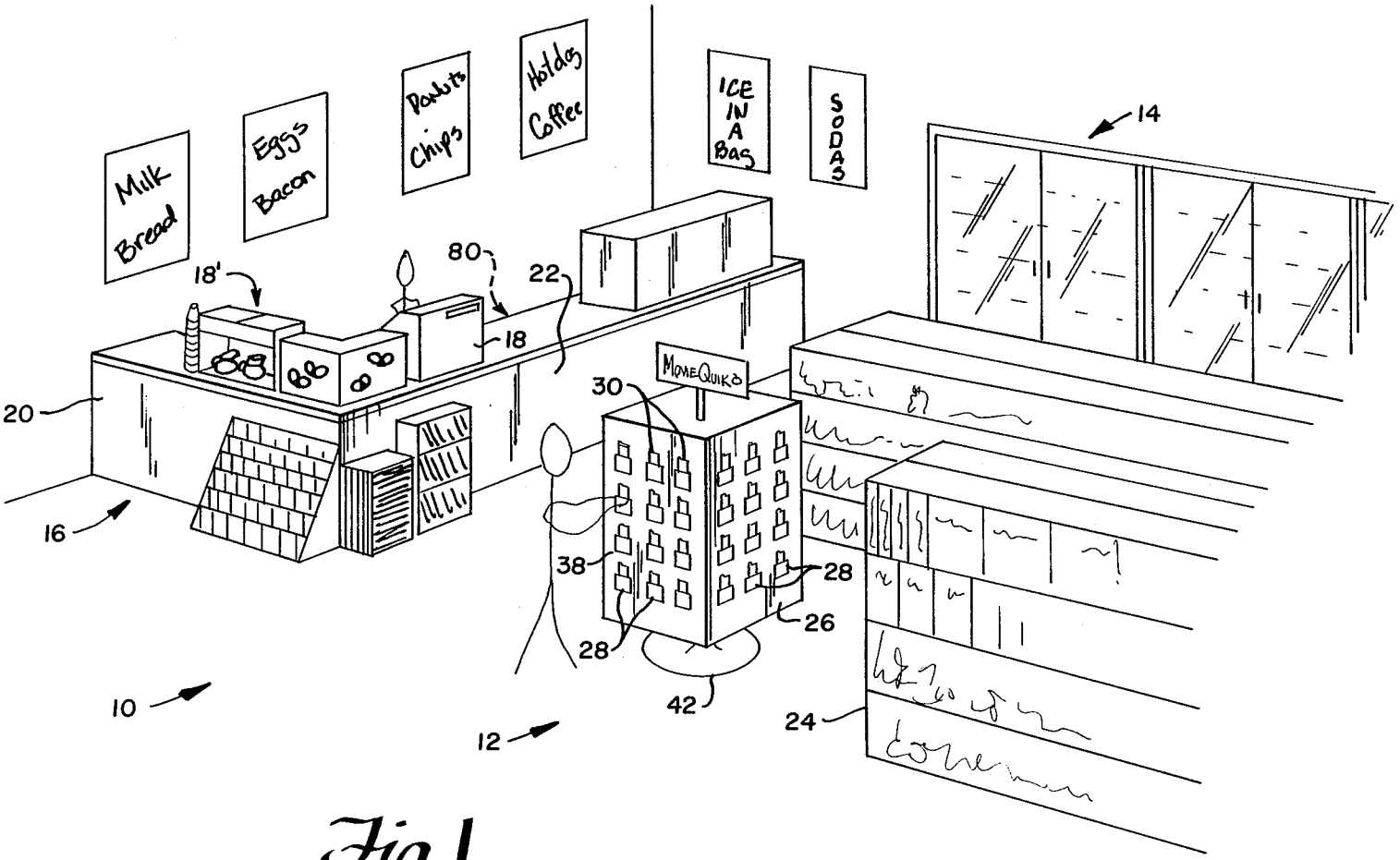
FIG. 1 is a schematic view of a store provided with a pre-recorded video cassette rental system embodying principles of the present invention.
Figure 2:
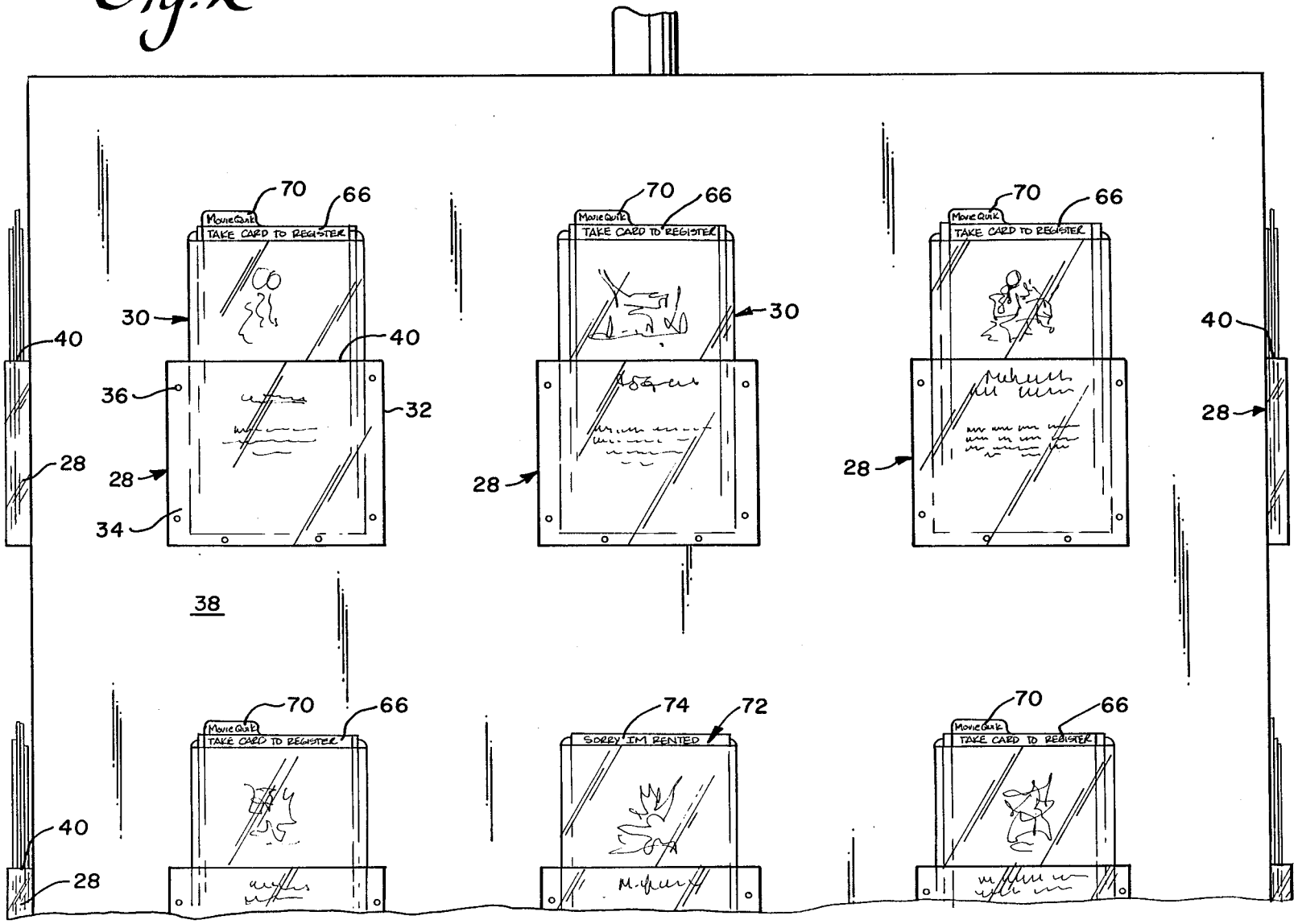
FIG. 2 is a fragmentary front elevational view of a typical display rack for the individual packets of cards.

FIG. 1 shows in schematic view a store 10 having a self-service sales area 12 which is accessible to customers, e.g. through an entrance 14. The store 10 is shown further provided with a check-out counter 16 having a register 18 for recording sales and holding change and payments received from customers. The check-out counter 16 typically separates the sales area 12 from a clerking area 18' to which the customers do not have direct access. Typically, the check-out counter 16 contains or encloses a behind- or an under-counter area, some portions of which may be used for display, as at 20, and other portions of which, generally indicated at 22 may be used for storage which is accessible to the clerks but not to the customers. Out on the sales floor, shelving, racks, bins and the like, generally indicated at 24 are typically provided stocked with goods for sale for self-service shopping by customers, who select their intending purchases and take them to the clerk at the check-out counter 16.

In practicing the present invention, the self-service sales area 12 accessible to customers is provided with one or more display racks 26 having cells 28 for display packets 30.

Each cell 28 is so constructed as to be generally vertically-elongated, front-facially substantially unobstructed to view, upwardly open, and provided with a holding means which is structured to permit substantially unobstructed view of the contents of the cell throughout substantially the full height of the cell, or at least throughout a substantial portion thereof. For instance, the front wall, opposite sidewalls and bottom wall of the cell, as well as most of the perimeter of its upwardly open mouth may be formed by a molded sheet of transparent plastic material 32, molded with an integral out-turned flange 34 which is secured, as at 36, to the backing wall 38, which also forms the back of each cell 28 and the remainder of the perimeter of its upwardly open mouth 40. Although the display rack 26 is shown being a vertically sided unit that is mounted on a pedestal 42 for manual rotation about a vertical axis, it may be one-sided, banked, wall-mounted or provided similarly to virtually any display rack meant for displaying individually accessible visible cells to store customers or the like, e.g. of the types conventionally used for displaying packets of garden seeds, sewing notions, recipe and nutrition booklets, employee time cards and the like.

Each cell 28 is shown removably containing a respective enveloped packet 44 which corresponds to a specific model of article or service which is availabe for purchase (sale or rent) at the store. (For convenience in discussion, it will be assumed that the rack 26 relates to the rental of pre-recorded video cassettes, and the reader will be expected to generalize an understanding of the principles of the invention from this specific but non-limitative example.)

Figure 4:
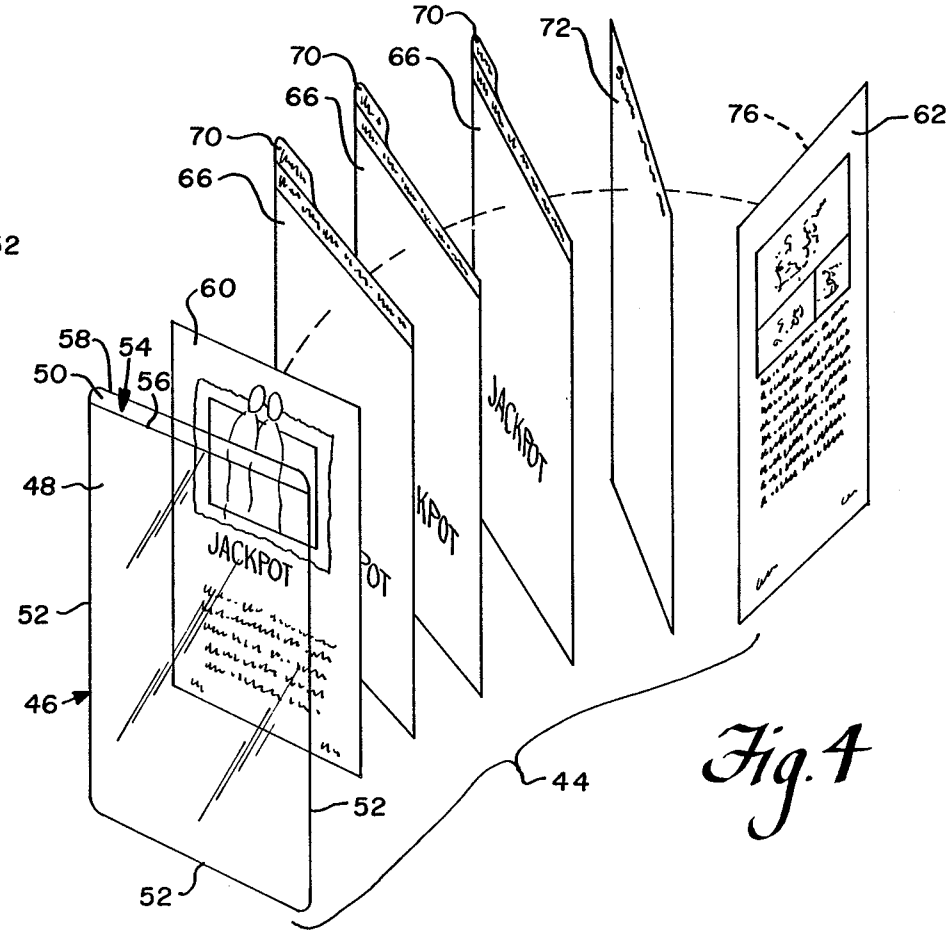
FIG. 4 is an exploded perspective view of the packet of FIG. 3.
Figure 3:
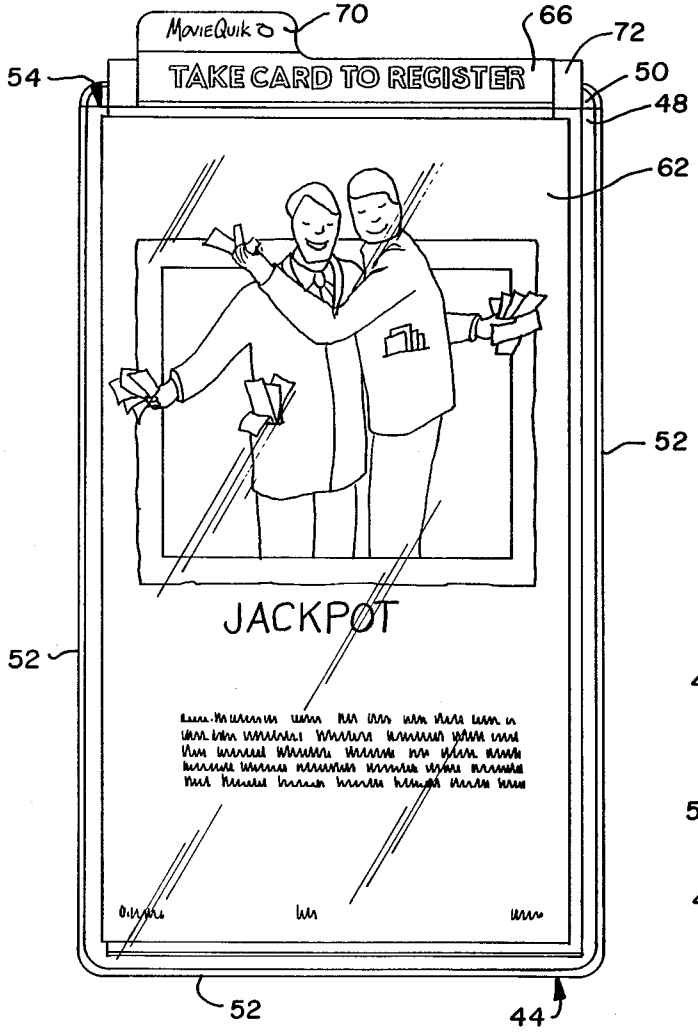
FIG. 3 is a front elevational view of a typical packet.

A typical enveloped packet 44 is shown in front elevational view in FIG. 3, and an exploded perspective view of it is shown in FIG. 4.

The unit 44 will be seen to include an upwardly open, generally flat envelope 46, typically constituted by front and rear sheets 48, 50 of transparent, flexible plastic material, e.g. polyvinylchloride, polyethyleneterephthalate or the like, thermally welded to one another along three corresponding edges, as at 52, so as to leave an upwardly open mouth 54 defined between unseamed upper edges 56, 58 of the sheets 48, 50. (Alternatively, either or both sheets could be made partly or wholly of opaque plastic material, in which case the display cards (to be described) could be fastened on the outside face or faces of these envelopes, rather than sleeved within them, with the result of perhaps making it more difficult to reuse the envelopes.)

Within the envelope 46 are shown contained a front display card 60 and a rear display card 62 which, typically, are the very cards which the publishers of the pre-recorded video cassettes provide as front and rear display cards for the boxes in which their products are furnished to the store. Typically, a front display card contains a logo-type of vignette or still from the movie, play or other work on which the video is based, its title, the names of characters, actors, songs or the like which appear in the work, and often credits, the publisher's name and/or logo, a copyright notice and other symbols, e.g. indicating that the soundtrack has been processed by a particular branded technique, or that the work is encoded with captions visible on command for hearing-impaired or language-limited persons whose viewing sets are suitably equipped. Typically a rear display card contains other vignettes, graphics, a synopsis of plot, comments of critics, other information and logography. Use of a rear display card is preferred but not essential to practicing the present invention. When desired, use of the rear display card may be omitted. By preference, the pocket 64 provided by the envelope 46 is at least as deep as the front and rear display cards 60, 62 are tall, so as to minimise the chance that, contrary to plan, the intending customer will withdraw either of these cards from the envelope 46.

In each full packet, sandwiched between the front and rear display cards 60 and 62 is at least one specific article token card 66, the number of such cards corresponding identically to the total number of copies of the particular title of pre-recorded cassette or the like which the store presently has in its inventory, available to be rented out to customers.

Each card 66 includes an upper end marginal portion which protrudes upwards out of the envelope, past the upper end of the front display card 60, by virtue of its being taller than the card 60, e.g. so as to display a horizontal band 68 which contains an inviting instructional command, e.g. TAKE ME TO THE REGISTER, and a protruding tab 70 which is subject to being easily grasped for pulling the respective token card 66 individually from the packet while leaving all else behind. By preference, the cards 60, 62, 66 are made of sufficiently slippery-surfaced stock on their mutally facing surfaces as to make it easy for an untutored intending customer to withdraw only one card 66, as intended, while leaving all the other cards behind in the envelope 46.

The enveloped packet 44 preferably further contains an additional, consolation card 72, which also protrudes above the upper edge of the front display card 60 and bears in an upper end band 74 a conciliatory message, e.g. SORRY, I'M RENTED. (In practice, the card 72 need not be a separate card, if the rear display card 62 is provided with an upper extension of its forwardly facing inner face 76 that is provided with the flag 74.)

In use, each cell of the display rack is stocked with an enveloped packet 44 containing a packet of cards relating to a specific pre-recorded video program as to which the store has at least one cassette available for rent. In most instances, the store will have one, two, three or four copies of that cassette available, so that in addition to the respective front display card 60, and the rear display card 62 (and/or the additional card 72, as explained above), the packet will contain, sandwiched between the aforementioned cards, the appropriate numbers of token cards 66. Each token card has printed on its body a title or stock number which will permit the store clerk to match it with a specific title or item. An intending customer will browse through the display rack, perhaps looking at several of the enveloped packets, perhaps temporarily lifting any of the enveloped packets, as a unit, out of the respective cells in order to look at the rearwardly facing outer faces of the rear display cards 62. Finally, the intending customer withdraws one or more TAKE ME TO THE REGISTER-flagged token cards bearing on the bodies the titles or stock numbers for corresponding specific movies he or she wants to rent and takes them to the clerk at the check-out stand (often along with other intending purchases such as milk, bread, soda and cat food), and goes through a familiar check-out process. In the course of this process, the clerk, upon reaching the token card or cards exchanges them for the respective actual cassette or cassettes held in reserve in the supply area, e.g. behind the counter at 80 that is inaccessible to the customer, Information about the customer and/or the transaction may be recorded on or attached to the card 66 which has been exchanged. Accordingly, as the system is in use, the display stand couples only with movies of which the store has one or more copies actually in stock, an invitation ("TAKE ME TO THE REGISTER") to the intending customer, and issues only in connection with movies of which the store temporarily has no copies in stock, an apology ("SORRY, I'M RENTED"). The display rack, in use, thus represents a precise, compact physical analog of what cassettes are in the supply area 80. And the store's behind-counter file of exchanged cards 66 represents a precise, compact physical analog of what cassettes are presently rented out. The latter file is easily periodically checked in order to contact customers in regard to overdue rental returns. When a rented cassette is returned, the clerk may easily return the respective card 66 to the respective envelope 46 and the respective cassette to the supply area 80. As new cassettes are acquired and old ones are withdrawn from rental, packets and supplies are correspondingly updated, with the clear plastic envelopes being re-used to the extend feasible.

It should now be apparent that the system for displaying, vending and controlling inventory of valuable articles such as pre-recorded videotape cassettes as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A merchandising system, comprising:

a store having a sales area which is accessible to customers and a clerking area which is separated from the sales area by a check-out counter;

a supply area for storing a plurality of different specific articles to be vended, this supply area being located so as to be accessible to clerks, from said clerking area, but not to customers, from said sales area;

at least one display rack for inviting customers to select said specific articles, said display rack having a plurality of individual cells which are located so as to be accessible to customers, from said sales area;

a plurality of enveloped packets, each enveloped packet being received in a respective said cell and comprising:

(a) a generally flat envelope having a front and a back and an open mouth;

(b) a front display card which is frontally visible when said envelope is frontally viewed, this front display card bearing, frontally thereof, non-verbal graphics and/or verbal indicia corresponding to a specific model of article from among said plurality of different specific articles, said front display card being carried by said envelope;

(c) at least one token card bearing, bodily thereof, indicia corresponding to said specific model of article, each said token card being removably receivable in said envelope, behind said front display card, so as to have an end portion thereof protruding out of said mouth and beyond said front display card, said end portion of each said token card bearing customer selection-inviting indicia; and (d) at least one additional card carried by said envelope behind said at least one token card when both are present, and having an end portion which protrudes out from behind said front display card and bears customer-consoling indicia visible frontally of said front display card.

2. The merchandising system of claim 1, wherein:

said enveloped packets, in total, are substantially less voluminous than said storage area.

3. The merchandising system of claim 2, further including:

a plurality of said different specific articles;

a file for withdrawn token cards;

some of said different specific articles being stored in said supply area and the remainder being out of said store in the hands of customers;

said token cards corresponding to said different specific articles stored in said display area being received in respective ones of said envelopes in respective ones of said cells of said at least one display rack; and said token cards corresponding to said remainder of said different specific articles being disposed in said file, whereby said at least one display rack presents said customer selection-inviting indicia to customers only in respect to said models of different specific articles which are actually stored in said supply area and presents said customer-consoling indicia to customers only in respect to said models of different specific articles all copies of which are in said remainder.

4. The merchandising system of claim 3, wherein:

said different specific articles are pre-recorded video programs.

5. The merchandising system of claim 3, wherein:

each said enveloped packet further comprises a rear display card which is frontally visible when said envelope is rearwardly viewed, this rear display card bearing, on an outer face thereof, non-verbal graphics and/or verbal indicia at least some of which corresponds to the same specific model of article as the front display card carried by the same said envelope, said rear display card being carried by said envelope.

6. The merchandising system of claim 5, wherein:

said different specific articles are pre-recorded video programs.

7. The merchandising system of claim 5, wherein:

each said envelope is made of transparent material and said front and rear display cards carried thereby are received therein through the mouth thereof, the corresponding said at least one token card when carried thereby being removably sandwiched between the corresponding said front and rear display cards.

8. Display stock for a merchandising system, comprising a plurality of enveloped packets, each comprising:

(a) a generally flat envelope having a front and a back and an open mouth;

(b) a front display card which is frontally visible when said envelope is frontally viewed, this front display card bearing, frontally thereof, non-verbal graphics and/or verbal indicia corresponding to a respective specific model of article from among a plurality of different specific articles, said front display card being carried by said envelope;

(c) at least one token card bearing, bodily thereof, indicia corresponding to said respective specific model of article, each said token card being removably receivable in said envelope, behind said front display card, so as to have an end portion thereof protruding out of said mouth and beyond said front display card, said end portion of each said token card bearing customer selection-inviting indicia; and (d) at least one additional card carried by said envelope behind said at least one token card when both are present, and having an end portion which protrudes out from behind said front display card and bears customer consoling indicia visible frontally of said front display card.

9. The display stock of claim 8, wherein:

each said enveloped packet further comprises a rear display card which is frontally visible when said envelope is rearwardly viewed, this rear display card bearing, on an outer face thereof, non-verbal graphics and/or verbal indicia at least some of which corresponds to the same specific model of article as the front display card carried by the same said envelope, said rear display card being carried by said envelope.

10. The display stock of claim 9, wherein:

each said envelope is made of transparent material and said front and rear display cards carried thereby are received therein through the mouth thereof, the corresponding said at least one token card when carried thereby being removably sandwiched between the corresponding said front and rear display cards.

11. A method for displaying, vending and controlling an inventory of valuable articles, comprising:

providing a store divided by a check-out counter into a sales area accessible to customers and a clerking area which is accessible to store employees but not to customers;

providing in said clerking area a supply area having a supply of a plurality of different specific articles to be vended from the store;

providing in said sales area at least one display rack for inviting customers to select said specific articles, said display rack having a plurality of individual cells which are located so as to be accessible to customers in said sales area;

providing each of a plurality of said cells of said display rack with a respective enveloped packet which comprises:

(a) a generally flat envelope having a front and a back and an open mouth;

(b) a front display card which is frontally visible when said envelope is frontally viewed, this front display card bearing, frontally thereof, non-verbal graphics and/or verbal indicia corresponding to a specific model of article from among said plurality of different specific articles, said front display card being carried by said envelope;

(c) at least one token card bearing, bodily thereof, indicia corresponding to said specific model of article, each said token card being removably receivable in said envelope, behind said front display card, so as to have an end portion thereof protruding out of said mouth and beyond said front display card, said end portion of each said token card bearing customer selection-inviting indicia; and (d) at least one additional card carried by said envelope behind said at least one token card when both are present, and having an end portion which protrudes out from behind said front display card and bears customer-consoling indicia visible frontally of said front display card;

some of said different specific articles being stored in said supply area and the remainder being out of said store in the hands of customers;

said token cards corresponding to said different specific articles stored in said display area being received in respective ones of said envelopes in respective ones of said cells of said at least one display rack; and said token cards corresponding to said remainder of said different specific articles being disposed in said file, whereby said at least one display rack presents said customer selection-inviting indicia to customers only in respect to said models of different specific articles which are actually stored in said supply area and presents said customer-consoling indicia to customers only in respect to said models of different specific articles all copies of which are in said remainder.

12. The method of claim 11, wherein:

said enveloped packets, in total, are substantially less voluminous than said storage area.

13. The method of claim 12, wherein:

said different specific articles are pre-recorded video programs.

14. The method of claim 12, wherein:

each said envelope is made of transparent material and said front and rear display cards carried thereby are received therein through the mouth thereof, the corresponding said at least one token card when carried thereby being removably sandwiched between the corresponding said front and rear display cards.

* * * * *